United States Patent [19]

Kolm et al.

[11] Patent Number: 4,595,338

[45] Date of Patent: Jun. 17, 1986

[54] NON-VIBRATIONAL OSCILLATING BLADE PIEZOELECTRIC BLOWER

[75] Inventors: Henry H. Kolm, Wayland; Robert E. Carter, Auburndale, both of Mass.

[73] Assignee: Piezo Electric Products, Inc., Cambridge, Mass.

[21] Appl. No.: 552,972

[22] Filed: Nov. 17, 1983

[51] Int. Cl.[4] ..... F01D 1/16

[52] U.S. Cl. ..... 416/81; 416/83; 417/322; 417/410; 310/348

[58] Field of Search ..... 417/240, 241, 322, 410, 417/413, 436; 416/3, 81, 83; 310/330, 332, 348

[56] References Cited

U.S. PATENT DOCUMENTS

| | | | |
|---|---|---|---|
| 1,486,040 | 3/1924 | Schieferstein | 416/81 |
| 3,040,976 | 6/1962 | De Mattos | 417/436 |
| 3,206,986 | 9/1965 | Christensen | 310/332 |
| 3,620,651 | 11/1971 | Hufton | 417/436 |
| 3,821,747 | 6/1974 | Mason | 310/332 |
| 4,063,826 | 12/1977 | Riepe | 417/410 |
| 4,131,874 | 12/1978 | Geohegan, Jr. | 310/337 |
| 4,172,427 | 10/1979 | Kindred | 416/83 |
| 4,176,976 | 12/1979 | Lendl | 310/328 |

FOREIGN PATENT DOCUMENTS

| | | | |
|---|---|---|---|
| 167983 | 3/1951 | Austria | 417/436 |
| 8002445 | 11/1980 | PCT Int'l Appl. | 417/322 |

OTHER PUBLICATIONS

Toda et al., "Vibrational Fan Using the Piezoelectric Polymer $PVF_2$", *Proceedings of the IEEE*, Aug. 1979, p. 1171.

*Primary Examiner*—Carlton R. Croyle
*Assistant Examiner*—Donald E. Stout
*Attorney, Agent, or Firm*—Joseph S. Iandiorio; William E. Noonan

[57] ABSTRACT

A non-vibrational oscillating blade piezoelectric blower is disclosed, including: a piezoelectric bender and means for supporting the piezoelectric bender at its inertial nodes. Weights may be attached to the bender to control the location of the inertial nodes. Flexible blades may be attached to the bender at various locations and with their planes in various orientations. The blower according to this invention may also consist of two benders oscillating 180 degrees out of phase to further minimize vibration and noise.

22 Claims, 7 Drawing Figures

NON-VIBRATIONAL OSCILLATING BLADE PIEZOELECTRIC BLOWER

FIELD OF INVENTION

This invention relates to a non-vibrational oscillating blade piezoelectric blower.

BACKGROUND OF INVENTION

Piezoelectric fans or blowers are available which use a piezoelectric bender attached at one end to a housing. A flexible blade is attached near or at the other, free end of the piezoelectric bender. When an alternating voltage is applied to the piezoelectric bender, the free end drives the flexible blade into oscillation and moves air or other fluid by generation and shedding of vortices from the tip of the blade, U.S. patent application, Ser. No. 477,630 filed Mar. 22, 1983, now U.S. Pat. No. 4,498,851. Such a device transmits vibrations to the housing. To reduce this vibration, the blowers are usually constructed with pairs of counter-oscillating piezoelectric benders and blades. This ordinarily eliminates vibration in the transverse mode due to the cancellation of momentum from the counter-oscillating benders and blades. However, since the blades perform arcuate oscillation, there are also momentum oscillations in the longitudinal direction which are not cancelled by the counter-oscillation in the transverse dimension. There results a longitudinal vibration of the housing, which can be absorbed if the blower is of substantially less mass than the housing, or if suitable damping can be provided. For larger blowers and where vibration causes problems, the longitudinal vibrations can be unacceptable. Employing a cancellation approach is not appropriate for a second counter-oscillating unit 180° out of phase with the main unit, for unless the second unit could be designed to do useful work it would double the cost, mass, volume and components of the system without adding to its performance.

SUMMARY OF INVENTION

It is, therefore, an object of this invention to provide an improved, simple and efficient non-vibrational oscillating blade piezoelectric blower.

It is a further object of this invention to provide such a blower which virtually eliminates longitudinal as well as transverse vibration.

It is a further object of this invention to provide such a blower which eliminates longitudinal vibration without the use of counter-oscillating compensating units.

It is a further object of this invention to provide such a blower using inertial nodal support of the piezoelectric bender.

The invention results from the realization that in an unconstrained piezoelectric bender undergoing flexural oscillation, there are two nodes which remain stationary and that a bender supported at only these nodes introduces virtually no longitudinal vibration. Blades can be attached to this bender at or near anti-nodes in various positions and orientations in order to perform blowing action. Such blades will shift the position of the inertial nodes. It is also possible to shift the position of the inertial nodes by attaching weights to the bender.

This invention features a non-vibrational oscillating blade piezoelectric blower, including a piezoelectric bender and means for supporting the piezoelectric bender at its inertial nodes. A flexible blade is mounted to the piezoelectric bender remote from the nodes and driven to oscillate by the piezoelectric bender. In one construction, the blade is mounted to the bender between the nodes and is generally parallel to the bender. The blade is mounted to one lateral edge of the bender and the second blade may be mounted to the opposite lateral edge of the bender. There may be a balancing weight mounted to the bender beyond each node, and the means for supporting may include an elastic mounting means for securing the piezoelectric bender.

In another construction, the inertial nodes may be disposed at the ends of the bender and the means for supporting may support the bender at its ends. Further, there may be a second bender having inertial nodes at its ends and also mounted to the means for supporting parallel to the first bender. The blade or blades may be mounted to the bender by a connecting bracket which stiffens the bender, and the blade or blades may be divided into a plurality of sections with a common base.

In another construction, the bender may extend beyond the nodes and a blade may be attached to the bender beyond each said node, and each blade may be mounted transversely to the bender.

In yet another construction, the bender is folded and includes first and second extended bender sections, each attached to one end of the bender and extending inwardly along, spaced from and parallel to the bender. The blade may include two separate blade portions, one attached to each of the adjacent inner ends of the bender sections. The bender may include a balancing weight mounted to it between the nodes. The elastic mounting means may have low internal damping and there may be a drive circuit for oscillating the bender.

DISCLOSURE OF PREFERRED EMBODIMENT

Other objects, features and advantages will occur from the following description of a preferred embodiment and the accompanying drawings, in which.

Figure 1:
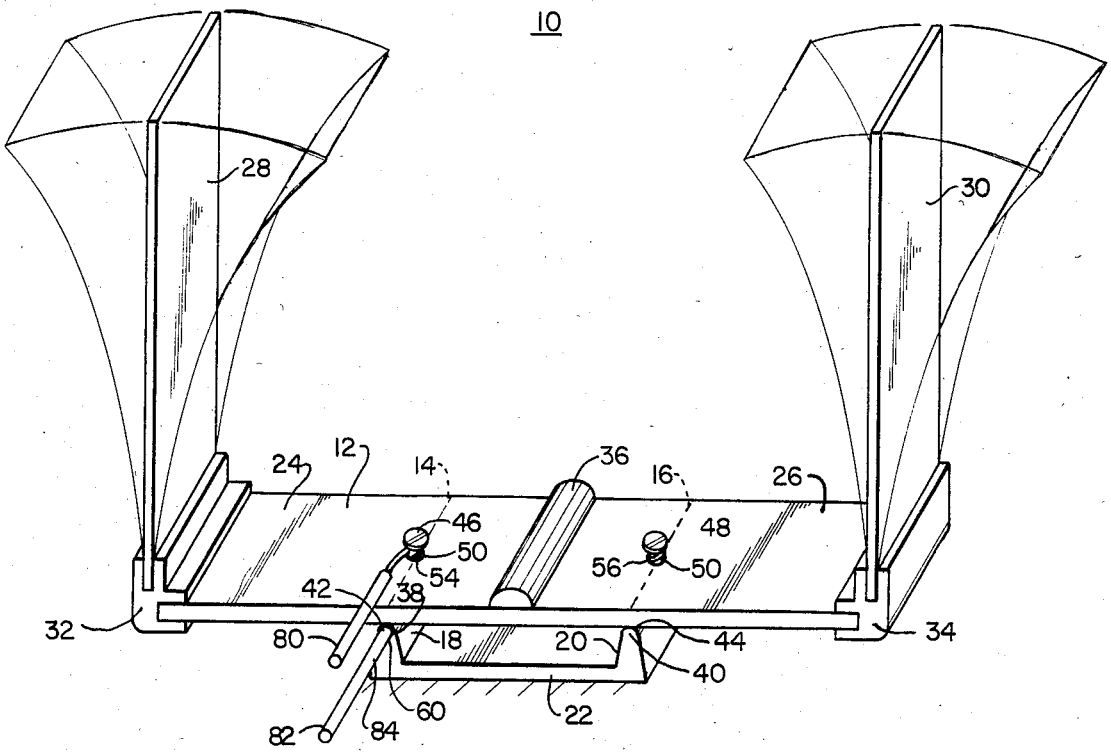
FIG. 1 is an axonometric view of a non-vibrational oscillating blade piezoelectric blower according to this invention with transverse end mounted blades.

There is shown in FIG. 1 a non-vibrational oscillating blade piezoelectric blower 10 according to this invention, including a piezoelectric bender 12 mounted at its inertial nodal pair points or lines 14 and 16 on mounting members 18 and 20 of yoke 22 which is fixed to a circuit board or housing.

In every body which undergoes flexural oscillation, there is a locus of points that remain fixed if the body is made to oscillate while free of any external force. This is a corrollary of the law of conservation of momentum. This is case of a linear flexural element such as a long narrow piezoelectric bender 12*a*, FIG. 2, the locus consists of two stationary points or lines 14*a*, 16*a*. As the bender 12*a* oscillates as shown, the conservation of momentum requires that these two nodes 14*a* and 16*a* remain stationary. These points, or lines, are herein referred to as the inertial nodal pair. Thus, as the bender is supported at these two points there is no longitudinal vibration transmitted to members 18 and 20 of yoke 22, FIG. 1, as the bender oscillates.

Figure 2:
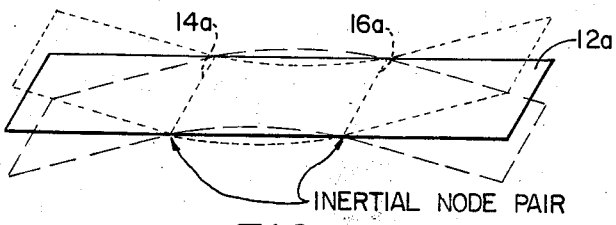
FIG. 2 is a schematic axonometric view showing the inertial node pair in an unconstrained piezoelectric bender.

The location of the inertial nodal pair 14*a*, 16*a*, FIG. 2, may be determined by standard experimental procedures, for instance by driving the entire assembly consisting of bender, blades and weights into oscillation at low amplitude with minimal support and observing the motion under stroboscopic light. At the outer ends 24, 26, FIG. 1, of bender 12, there are mounted flexible blades 28 and 30, disposed normal to bender 12 and secured thereto by some means such as an adhesive or interconnection blocks 32, 34. Blades 28, 30 are parallel to one another and counter-oscillate simultaneously toward and away from each other so that any transverse vibration cancels, resulting in virtually vibration-free operation in the transverse and longitudinal directions.

Figure 3:
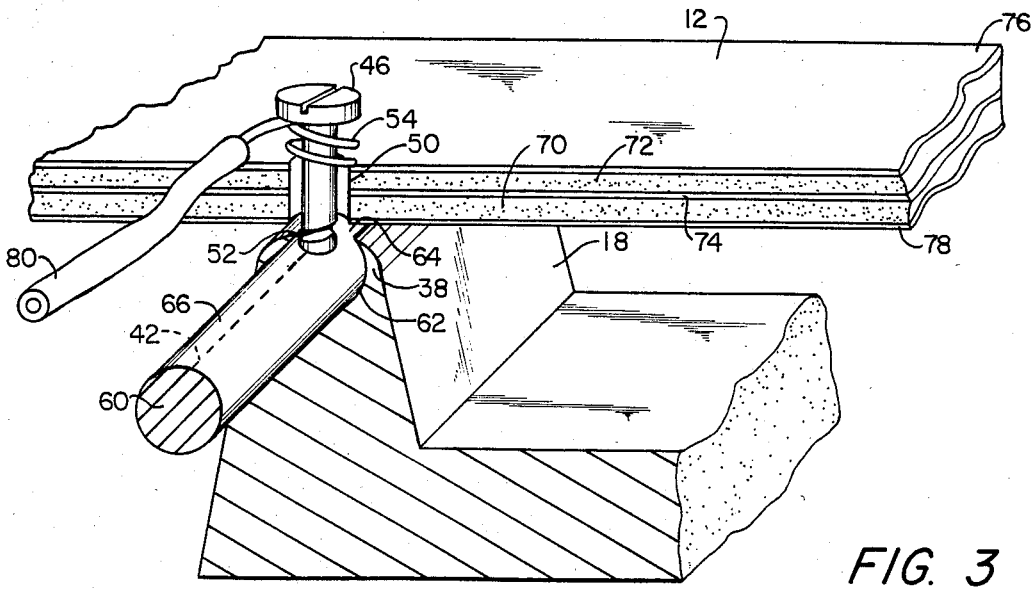
FIG. 3 is an enlarged sectional view of a portion of the non-vibrational oscillating blade piezoelectric blower of FIG. 1.

A balance weight 36, FIG. 1, may be disposed between inertial nodes 14 and 16 to bring the inertial nodes closer to each other and to adjust the resonant frequency of the blower as desired. Members 18 and 20 may have a curved top portion 38 and 40 to provide a line contact support 42, 44 to coincide with the node lines 14 and 16. Bender 12 may be fastened to members 18 and 20 by means of screws 46, 48 which pass through clearance holes 50 in bender 12 and engage in threaded holes 52, FIG. 3, in members 18 and 20. Steel springs 54 and 56 mounted beneath the heads of screws 46 and 48 resiliently secure bender 12 against support members 18 and 20 of yoke 22. As illustrated with respect to member 18, the rounded portion 38, FIG. 3, may be formed by a circular steel rod 60 inserted in bore 62. Its upper area 64 is open so that the top, curved surface 66 of rod 60 actually provides the line 42 of contact with bender 12. The steel rod support can also be replaced by a resilient support, such as a second steel spring underneath the bender. Bender 12 is formed of a plurality of piezoelectric layers, including at least two piezoelectric layers 70, 72, separated by an elastic conducting member 74 and bear on their external surfaces electrode material 76, 78. Electrical connection may be made to electrode 76 through wire 80 which engages screw 46 and spring 54. Electrical connection to electrode 78 may be made through wire 82, FIG. 1, which interconnects with a solder lug 84 attached to steel rod 60.

In a specific embodiment, blades 28 and 30 may be formed of material such as Mylar polyester having the dimensions 5 to 14 mils thick, one inch wide, with the length adjusted to resonate at the desired frequency and with a high Q as described in pending application Ser. No. 477,630. Bender 12 is typically 1.5 inches long 0.75 inch wide, .022 inch thick, and is formed of piezoelectric layes 70 and 72 of lead zirconate titanate piezoceramic material, 0.008 inch thick. Center shim 74 is brass or steel, 0.004 inch thick, and electrodes 76, 78 are nickel or silver plating, 0.0001 inch thick. Balance weight 36 is two grams, as determined by experiment. Screws 46, 48 are made of insulating material and springs 54, 56 are formed of an elastic material having very low internal damping such as brass, phosphor bronze, or beryllium bronze. The inertial nodal pair occur centered on bender 12 and spaced apart a distance of about one inch.

Figure 4:
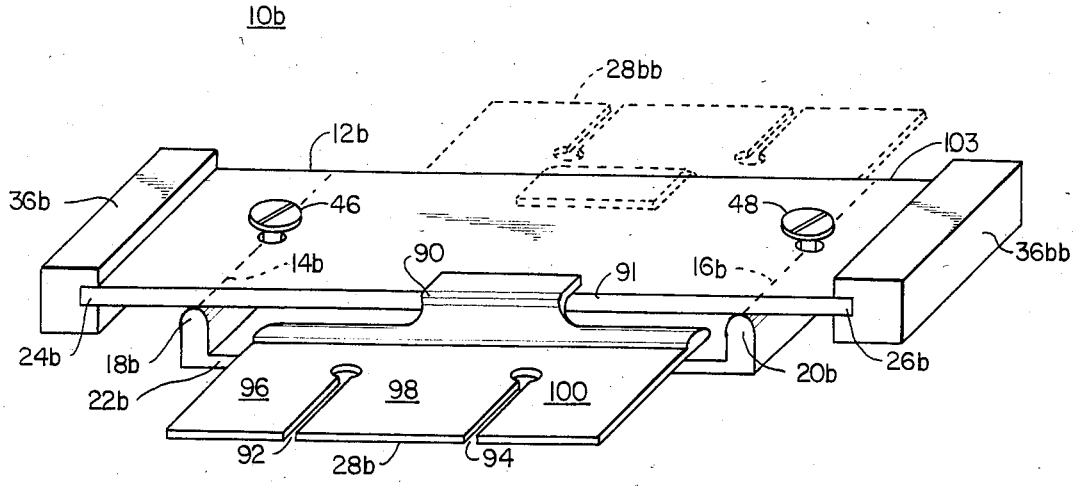
FIG. 4 is an axonometric view of another construction of a non-vibrational oscillating blade piezoelectric blower according to this invention with a parallel, centrally mounted blade.
Figure 7:
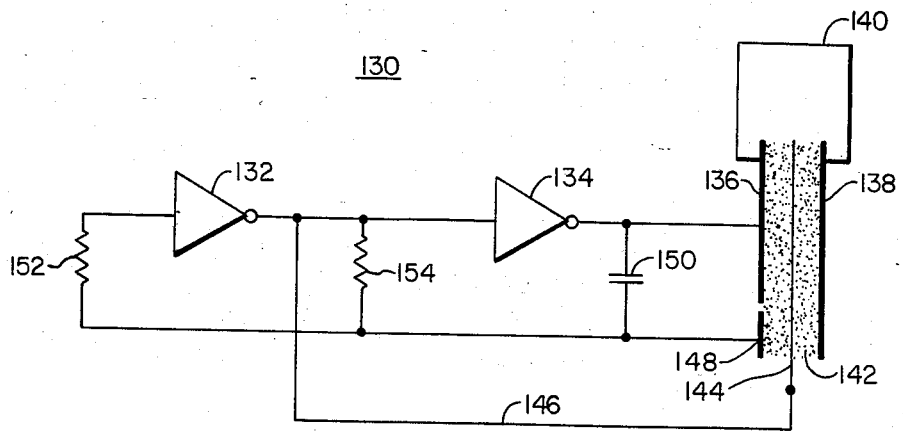
FIG. 7 is a schematic diagram of a driver circuit for driving the benders according to this invention.

In another construction, blower 10*b*, FIG. 4, includes a piezoelectric bender 12*b* mounted at its inertial nodes 14*b*, 16*b*, by mounting members 18*b* and 20*b* of yoke 22*b*. At the outer ends 24*b*, 26*b* of bender 12*b* are secured balance weights 36*b* and 36*bb*. Blade 28*b* is centrally connected to bender 12*b* between nodes 14 and 16 by means of an interconnection element 90 connected to lateral edge 91 of bender 12*b*, which serves to stiffen blade 28*b*. Blade 28*b* may be provided with slots 92, 94 which divide it into three portions 96, 98 and 100. This separation of blade 28*b* into three parts provides a quieter blowing action. A second blade 28*bb* may be provided on the opposite lateral edge 93 of bender 12*b*. Blades 28*b* and 28*bb* are generally parallel to bender 12. Blower 10*b* of FIG. 4 is particularly suited to miniature low-profile applications and is suitable for use as a spot cooler mounted directly on a printed circuit board. It can be fabricated to have a total height of less than one half inch above the mounting surface. Miniature blowers of this type perform best at a frequency of about 400 Hz, but it may be expedient to operate them at about 200 Hz in order to minimize the acoustic noise. The blower can be operated at a voltage as low as 12 volts d.c. and driven by a self-tuning electronic circuit which is supplied with direct current and generates an alternating voltage automatically adjusted to the resonant frequency of the bender of the attached blade and weights, as shown in FIG. 7. The weights on the outer ends of bender 12*b* move the inertial nodes outward and increase the amplitude of oscillation at the center of the bender. Blower 12*b* can deliver air velocity of 400 ft./minute, and with a second blade it can be made to blow in opposite directions simultaneously.

Figure 5:
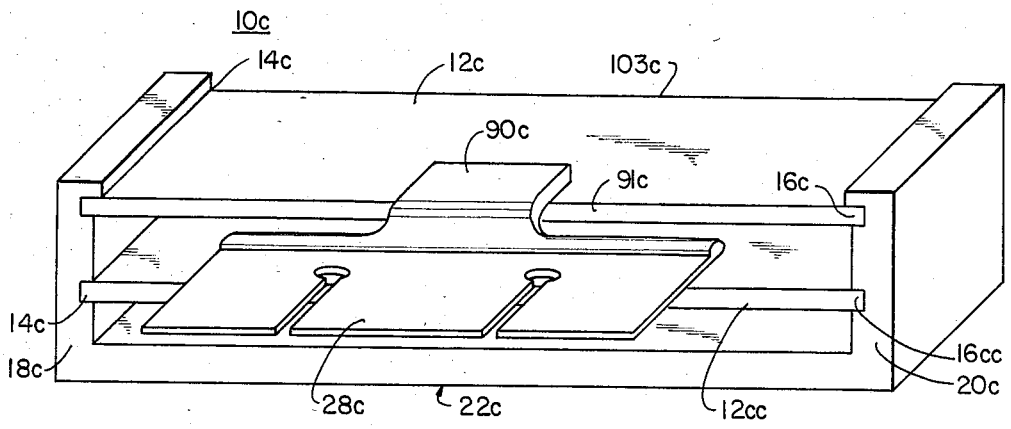
FIG. 5 is an axonometric view of yet another non-vibrational oscillating blade piezoelectric blower according to this invention with end nodes, a parallel mounted blade, and a second counter-oscillating bender.

Alternatively, blower 10*c*, FIG. 5, may be constructed using two counteroscillating benders 12*c* and 12*cc* whose combined nodes 14*c*, 14*cc* and 16*c*, 16*cc* are at their ends connected to upstanding members 18*c*, 20*c* of yoke 22*c*. Blade 28*c* may be connected centrally of bender 12*c* by bracket 90*c* as explained with reference to FIG. 4, and a second blade on the opposite lateral edge 103*c* may be mounted in the same way if desired. Both blades 28*c* and 28*cc* may be generally parallel to bender 12*c*. Bender 12*c* is driven to oscillate simultaneously oppositely to bender 12*c*. The counter-oscillation mode of bender 12*cc* cancels complementary vibrations of bender 12*c*.

Figure 6:
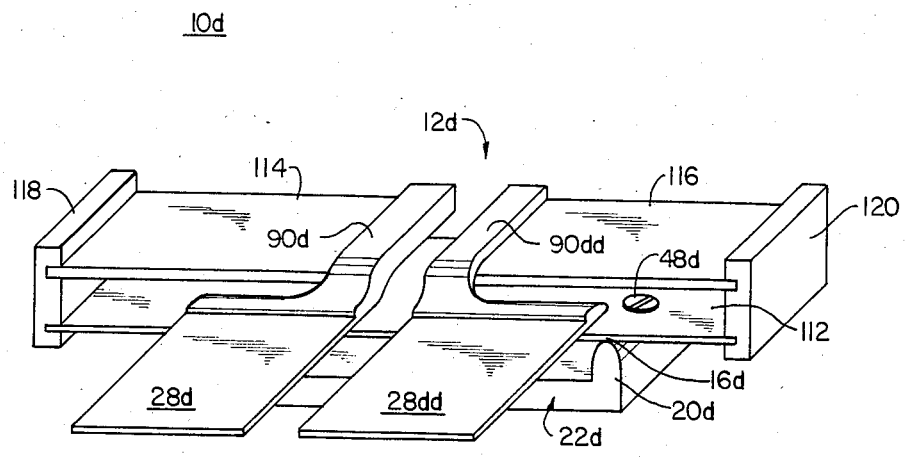
FIG. 6 is an axonometric view of yet another non-vibrational oscillating blade piezoelectric blower according to this invention with a folded bender and split blade construction.

Increased deflection may be obtained from blower 10*d*, FIG. 6, which includes a folded bender 12*d* mounted at its nodal points 14*d*, 16*d* on members 18*d*, 20*d* of yoke 22*d* (points 14*d* and 18*d* not visible). Folded bender 12*d* includes primary bender 112 mounted at its nodes 14*d* and 16*d* on members 18*d*, 20*d* of yoke 22*d*. Folded bender 12*d* also includes two extender bender sections 114 and 116 which are connected at their outer ends with the ends of bender 112 by means of interconnection blocks 118 and 120. Benders 114 and 116 extend inwardly spaced from and parallel to bender 112, and at their inner ends support blades 28*d* and 28*dd* supported by brackets 90*d* and 90*dd*. The bender 112 and benders 114 and 116 counter-oscillate so that the outer extremities of bender 112 and the three inner extremities of benders 114 and 116 all move upward and downward, respectively, in unison. This results in the maximum possible amplitude of the three inner extremities of the upper benders. This construction is also particularly suitable for miniature low-profile applications, especially where operation at the lowest possible voltage direct current is required.

Acceptable performance has been achieved at a resonant driving voltage using a self-tuning circuit 130, FIG. 7, which includes two converting amplifiers 132, 134 in series driving outer electrodes 136 and 138 interconnected by line 140. Through circuit 130, piezoelectric bender 142 is driven at resonance. Center electrode 144, made of shimstock, is connected to the input of amplifier 13 via line 146. Feedback electrode 148 is connected to the output of inverter 134 through capacitor 150 and to the inputs of amplifiers 132, 134 through feedback resistors 152, 154, respectively.

Other embodiments will occur to those skilled in the art and are within the following claims:

What is claimed is:

1. A non-vibrational oscillating blade piezoelectric blower comprising: a piezelectric bender having at least two spaced inertial nodes; means for supporting said piezoelelctric bender at each of said inertial nodes; and a flexible blade mounted to said piezoelectric bender remote from said nodes and driven to oscillate by said piezoelectric bender.

2. The blower of claim 1 in which said blade is mounted to said bender between said nodes.

3. The blower of claim 1 in which said blade is generally parallel to said bender.

4. The blower of claim 3 in which said blade is mounted to one lateral edge of said bender and a second blade is mounted to the opposite lateral edge of said bender.

5. The blower of claim 1 further including a balancing weight mounted to said bender beyond each said node.

6. The blower of claim 1 in which said means for supporting includes elastic mounting means for securing said piezoelectric bender.

7. The blower of claim 1 in which the inertial nodes are at the ends of said bender and said means for supporting support said bender at its ends.

8. The blower of claim 7 further including a second bender having inertial nodes at its ends and mounted to said means for supporting parallel to the first said bender.

9. The blower of claim 1 in which said blade is mounted to said bender by a connecting bracket which stiffens said blade.

10. The blower of claim 1 in which said blade is divided into a plurality of sections with a common base.

11. The blower of claim 1 in which said bender extends beyond said nodes and there is a blade attached to said bender beyond each said node.

12. The blower of claim 11 in which said blades are attached transversely of said bender.

13. The blower of claim 11 in which said bender is folded and includes first and second extended bender sections each attached to one end of said bender and extending inwardly along, spaced from, and parallel to said bender.

14. The blower of claim 13 in which said blade includes two separate blade portions one attached to each of the adjacent inner ends of said bender sections.

15. The blower of claim 1 in which said bender includes a balancing weight mounted to said bender between said nodes.

16. The blower of claim 1 in which said means for supporting have low internal damping.

17. The blower of claim 1 further including a drive circuit for oscillating said bender at resonance.

18. A non-vibrational oscillating blade piezoelectric blower comprising: a piezoelectric bender having at least two spaced inertial nodes; means for supporting said piezoelectric bender at its inertial nodes; and at least one flexible blade mounted parallel to and along a lateral edge of said piezoelectric bender between said nodes and driven to oscillate by said piezoelectric bender.

19. The blower of claim 18 in which said bender includes a balancing weight beyond each node.

20. A non-vibrational oscillating blade piezoelectric blower comprising: a piezoelectric bender having an inertial node at each end; means for supporting said piezoelectric bender at its inertial nodes; and at least one flexible blade mounted parallel to and along a lateral edge of said piezoelectric bender between said nodes and driven to oscillate by said piezoelectric bender.

21. The blower of claim 20 further including a second bender having inertial nodes at its ends and mounted to said means for supporting parallel to the first said bender.

22. A non-vibrational oscillating blade piezoelectric blower comprising: a folded piezoelectric bender having at least two spaced inertial nodes and including first and second extended bender sections each attached to one end of said bender and extending inwardly along, spaced from and parallel to said bender; means for supporting said piezoelectric bender at its inertial nodes; a flexible blade including two separate blade portions one attached to each of the adjacent inner ends of said bender sections and driven to oscillate by said piezoelectric bender.

* * * * *